US005894738A

United States Patent [19]

Choi

[11] Patent Number: 5,894,738

[45] Date of Patent: Apr. 20, 1999

[54] REFRIGERATOR HAVING A WATER-FEEDING APPARATUS WITH A CURRENT DETECTING PART

[75] Inventor: Seung-Jin Choi, Incheon, Rep. of Korea

[73] Assignee: Daewoo Electronics Co., Ltd., Seoul, Rep. of Korea

[21] Appl. No.: 08/960,235

[22] Filed: Oct. 29, 1997

[30] Foreign Application Priority Data

Oct. 30, 1996 [KR] Rep. of Korea ..... 96-50370

[51] Int. Cl.[6] ..... F25C 1/10

[52] U.S. Cl. ..... 62/340; 62/189

[58] Field of Search ..... 62/126, 129, 130, 62/135, 136, 137, 138, 340, 344, 389, 177, 188, 189

[56] References Cited

U.S. PATENT DOCUMENTS

| | | | |
|---|---|---|---|
| 4,815,941 | 3/1989 | Fayo | 62/340 X |
| 4,987,746 | 1/1991 | Roberts | 62/340 |
| 5,440,892 | 8/1995 | Tatematsu et al. | 62/135 |

*Primary Examiner*—Harry B. Tanner
*Attorney, Agent, or Firm*—Pillsbury Madison & Sutro LLP

[57] ABSTRACT

A refrigerator has a water tank, a pump with a motor, a current detecting part, and a controller. The current detecting part detects a motor current flowing through the motor so that the current detecting part outputs control signals like a binary of high/low level according to the detected motor current. The controller turns on/off the motor according to the control signal from the current detecting part. By this refrigerator, the existence of the water in the water tank may be detected accurately.

6 Claims, 4 Drawing Sheets

REFRIGERATOR HAVING A WATER-FEEDING APPARATUS WITH A CURRENT DETECTING PART

BACKGROUND OF THE INVENTION

1. Field of the Invention

The present invention relates to a refrigerator with a water-feeding apparatus, more particularly to a refrigerator having a water-feeding apparatus with a current detecting part in which a controller turns on or turns off a motor in a water-feeding pump according to a current through the motor.

2. Prior Art

In conventional refrigerators, there are refrigerators in which refrigeration occurs automatically by an automatic water-feed.

FIG. 1 shows a conventional refrigerator with a conventional water-feeding apparatus. As shown in FIG. 1, the conventional refrigerator has a first tank 101, a second tank 102, a valve 103, a water-feeding pump 104, a water-feeding motor 105, a water-feeding impeller 106, a water-feeding tube 107, a water-feeding motor driver 108, a water-refrigerating container 109, a taking-out motor 110, a taking-out motor driver 117, a controller 112, a water-detecting sensor 113, a displayer 114, a timer 115, and a water-refrigerating sensor 116.

The first tank 101 stores water supplied from outside. The second tank 102 stores the water supplied from the first tank 101. The valve 103 comprises a stick inserted into a spring, and a cork formed at the lower part of the stick. By the valve 103, the water in the first tank 101 flows into the second tank 102 up to a predetermined amount. That is, if the water in the first tank 101 is filled up, the stick is pushed downwardly so that the cork is open. Finally, the water in the first tank 101 flows into the second tank 102. Then, if the water in the second tank 102 is full up to a predetermined height, the cork is pushed upwardly by buoyancy of the water in the second tank 102 so that the valve 103 is closed.

The water-feeding pump 104 comprises the water-feeding motor 105 and the water-feeding impeller 106. The water-feeding pump 104 feeds the water in the second tank 102 to the water-refrigerating container 109 via the water-feeding tube 107. The water-refrigerating container 109 is installed in a refrigerating room (not shown) for refrigerating water. The taking-out motor 110 twists the water-refrigerating container 109 in order to take out the ice in the water-refrigerating container 109.

The water-feeding motor driver 108 drives the water-feeding motor 105 according to a water-feeding control signal. The taking-out motor driver 111 drives the taking-out motor 110 according to a taking-out control signal.

The water-detecting sensor 113 measures the amount of the water stored in the second tank 102. The displayer 114 displays functions of the refrigerator. The timer 115 counts the time needed for refrigerating water. The water-refrigerating sensor 116 is installed on the outer surface of the water-refrigerating container 109 to measure the temperature of the water-refrigerating container 109. The controller 112 controls all the functions of the refrigerator.

The operation of the conventional refrigerator with the above-mentioned constitution is as follows. If water is supplied to the first tank 101 by a user and a predetermined amount of the water is filled, the valve 103 is opened by the weight of the water, and the water in the first tank 101 flows into the second tank 102 via the valve 103. Then, if the water in the second tank 102 is filled up to a predetermined height, a full state of the water in the second tank 102 is detected by the water-detecting sensor 113. At this time, the controller 112 drives the water-feeding motor 105 by controlling the water-feeding motor driver 108 so that a predetermined amount of water is fed to the water-refrigerating container 109. The water-feed continues until the output signal of the water-detecting sensor 113 changes from a turn-on signal to a turn-off signal. When the water-feed ends, the controller 112 receives a counted time period from the timer 115, and a measured temperature from the water-refrigerating sensor 116. For example, when the counted time is 2.4 hours and the measured temperature is −12.5 Celsius, the controller 112 drives the taking-out motor 110 by controlling the taking-out motor driver 111 so that the ice in the water-refrigerating container 109 is taken out. At this time, the water-refrigeration ends and a next water-feed begins.

The conventional refrigerator is convenient for a user due to the automatic water-feed and taking-out.

However, as shown in FIG. 2, when the water-detecting sensor 113 malfunctions, that is, when disconnection between a first detecting bar 202 and a second detecting bar 204 is not done by the surface tension, existence of the water is detected even if there is no water. Then, the water-refrigeration continues even if the water is not full. Also, excess water is fed to the water-refrigerating container 109 so that the excess water overflows out of the water-refrigerating container 109.

SUMMARY OF THE INVENTION

The present invention is provided to solve the above-mentioned problem in the conventional refrigerator with the water-feeding apparatus. An object of the present invention is to provide a refrigerator with a water-feeding apparatus which feeds the water in the water tank into a water-refrigerating container according to control signals based on a detected current of a water-feeding motor, regardless of a malfunction of the conventional water-detecting sensor or alone without the conventional water-detecting sensor.

To obtain the above-mentioned object, the present invention provides a refrigerator with a water-feeding apparatus which comprises a water tank for storing water, a water-refrigerating container for storing the water fed from the water tank via a water-feeding tube, a water-feeding pump with a motor for feeding the water in the water tank into the water-refrigerating container, a current detecting part for detecting current flowing through the motor and for outputting control signals according to the current, and a controller for controlling revolution of the motor according to the control signals.

The operation of the above-mentioned refrigerator is as follows. The current detecting part measures a current flowing through the water-feeding motor, where the amplitude of the current changes according to the existence of the water in the water tank, and outputs a control signal like a binary signal. The controller turns on/off the water-feeding motor according to the control signal.

Therefore, by using the refrigerator with the water-feeding apparatus according to the present invention as a substitute or an aid when the water-detecting sensor does not exist or malfunctions respectively, a normal water-feed may be accomplished.

BRIEF DESCRIPTION OF THE DRAWINGS

The above-mentioned object and other advantages of the present invention will become apparent by describing in detail a preferred embodiment thereof with reference to the attached drawings in which.

DESCRIPTION OF THE PREFERRED EMBODIMENT

Hereafter, the constitution of the refrigerator having a water-feeding apparatus with a current detecting part according to the present invention will be described.

Figure 1:
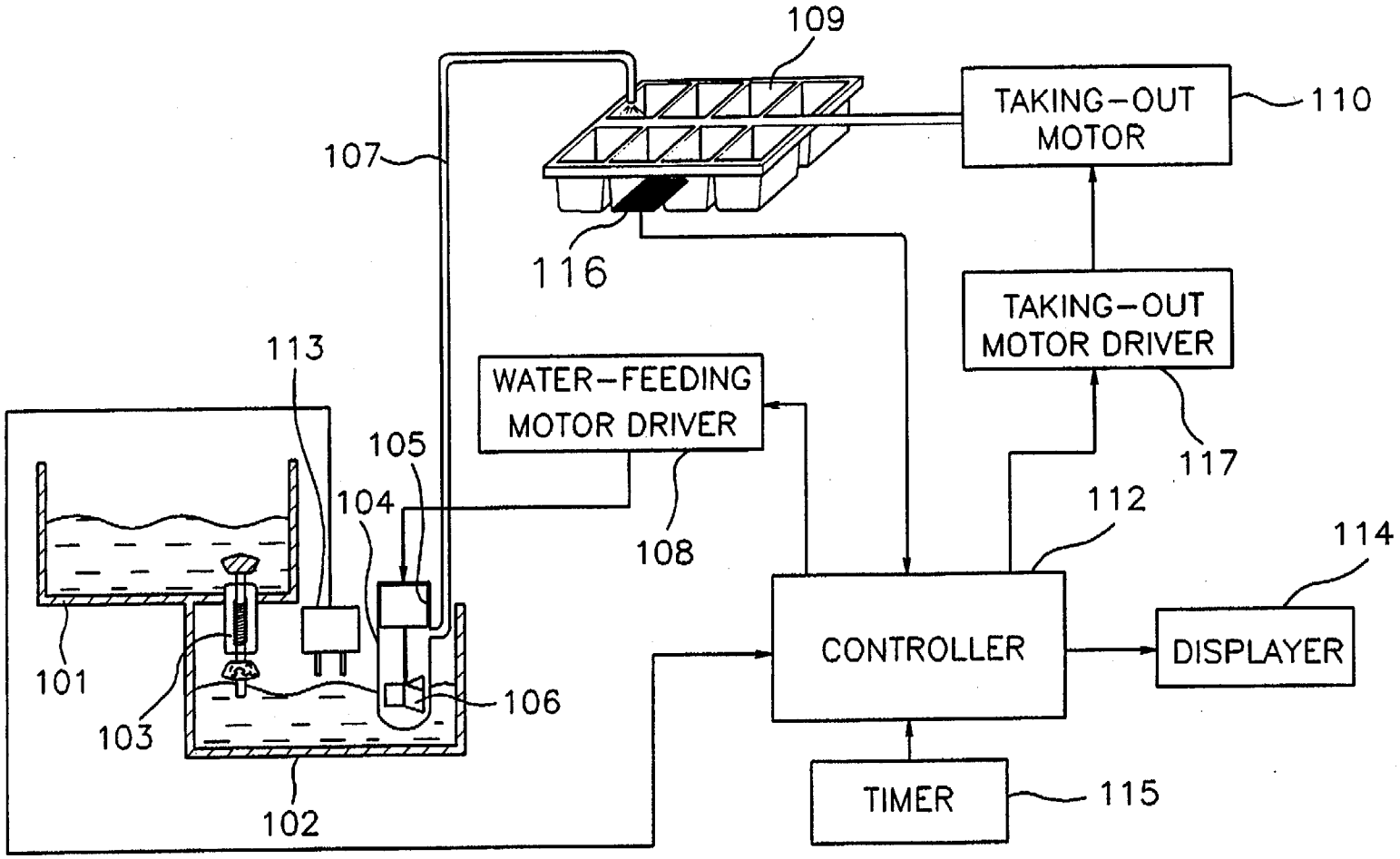
FIG. 1 PRIOR ART
FIG. 1 is a construction view roughly showing a conventional refrigerator with a water-feeding apparatus.
Figure 2:
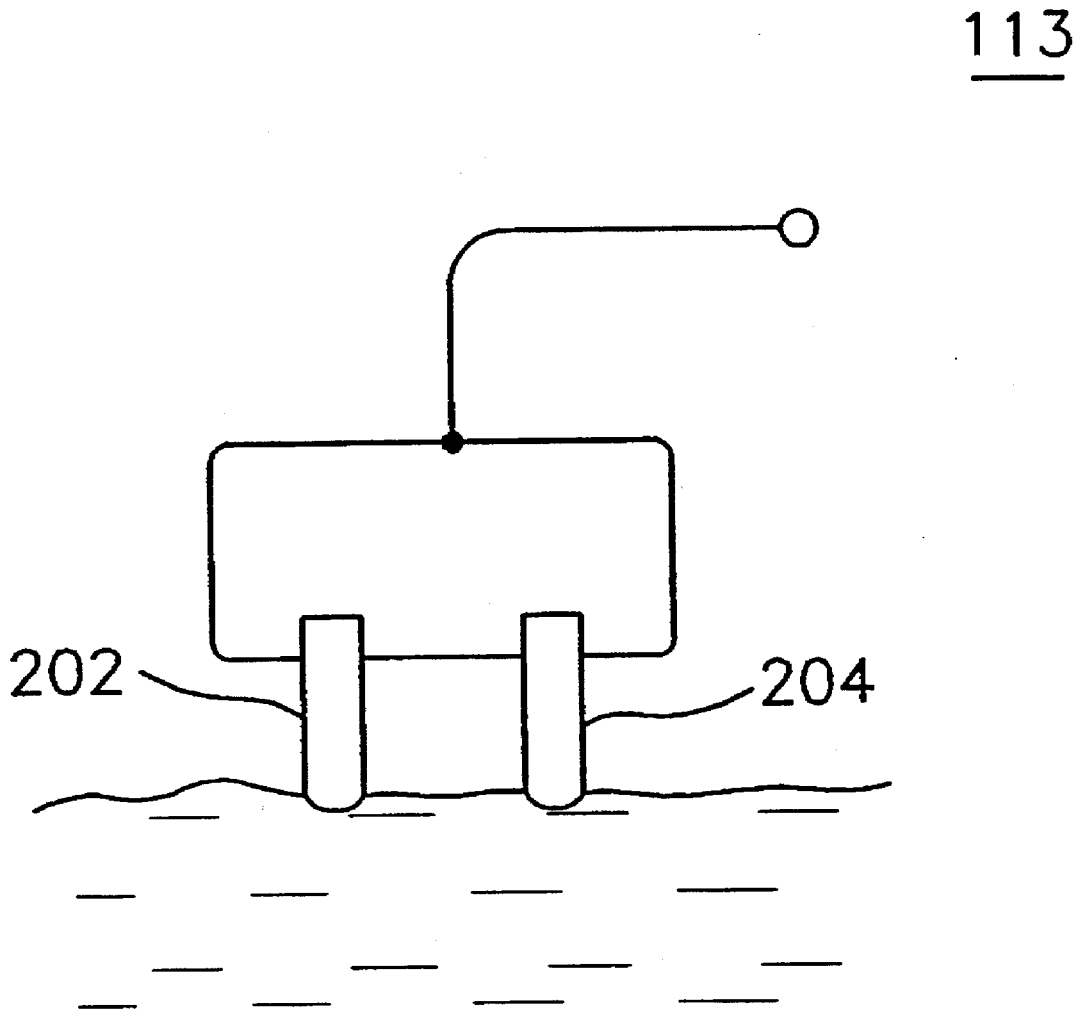
FIG. 2 PRIOR ART
FIG. 2 is a front view roughly showing a water-detecting sensor of FIG. 1.
Figure 3:
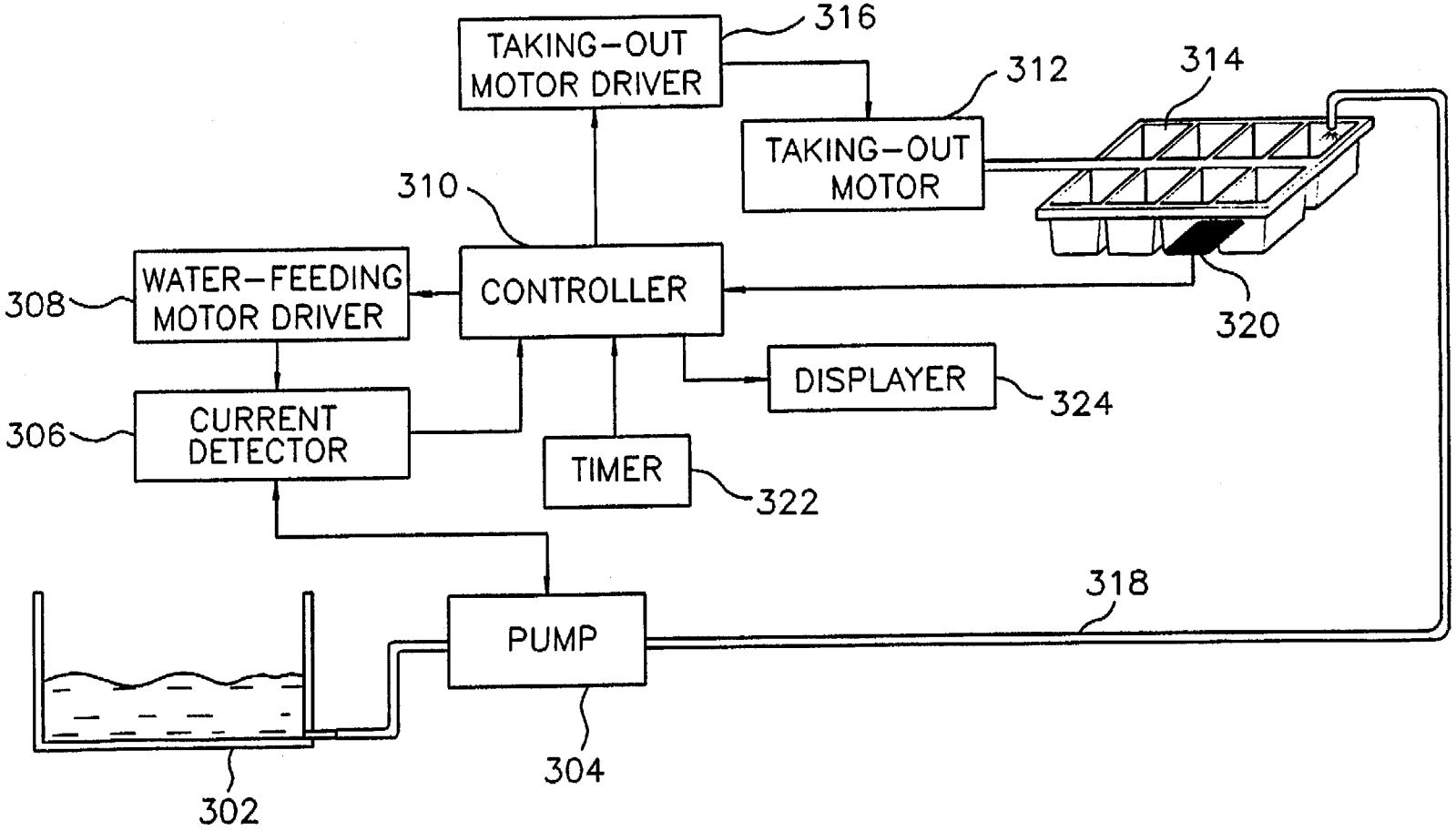
FIG. 3 is a construction view which roughly shows a refrigerator having a water-feeding apparatus with a current detecting part according to the present invention.

FIG. 3 is a construction view which roughly shows a refrigerator having a water-feeding apparatus with a current detecting part according to the present invention. As shown in FIG. 3, the refrigerator according to the present invention has a water tank 302, a water-feeding pump 304, a current detecting part 306, a water-feeding motor driver 308, a controller 310, a taking-out motor 312, a water-refrigerating container 314, a taking-out motor driver 316, a water-feeding tube 318, a water-refrigerating sensor 320, a timer 322, and a displayer 324.

The water tank 302 stores water supplied from outside. The water tank 302 is linked to the water-refrigerating container 314 through the water-feeding tube 318.

The water-feeding motor driver 308 is linked to the controller 310 and the water-feeding pump 304. The current detecting part 306 is linked between the water-feeding motor driver 308 and water-feeding pump 304, and also is linked to the controller 310.

The taking-out motor driver 316 is linked to the controller 310 and the taking-out motor 312. The taking-out motor 312 is linked to the water-refrigerating container 314. The water-refrigerating sensor 320, which is installed on the lower surface of the water-refrigerating container 314, is linked to the controller 310.

The timer 322 and the displayer 324 respectively are linked to the controller 310.

Figure 4:
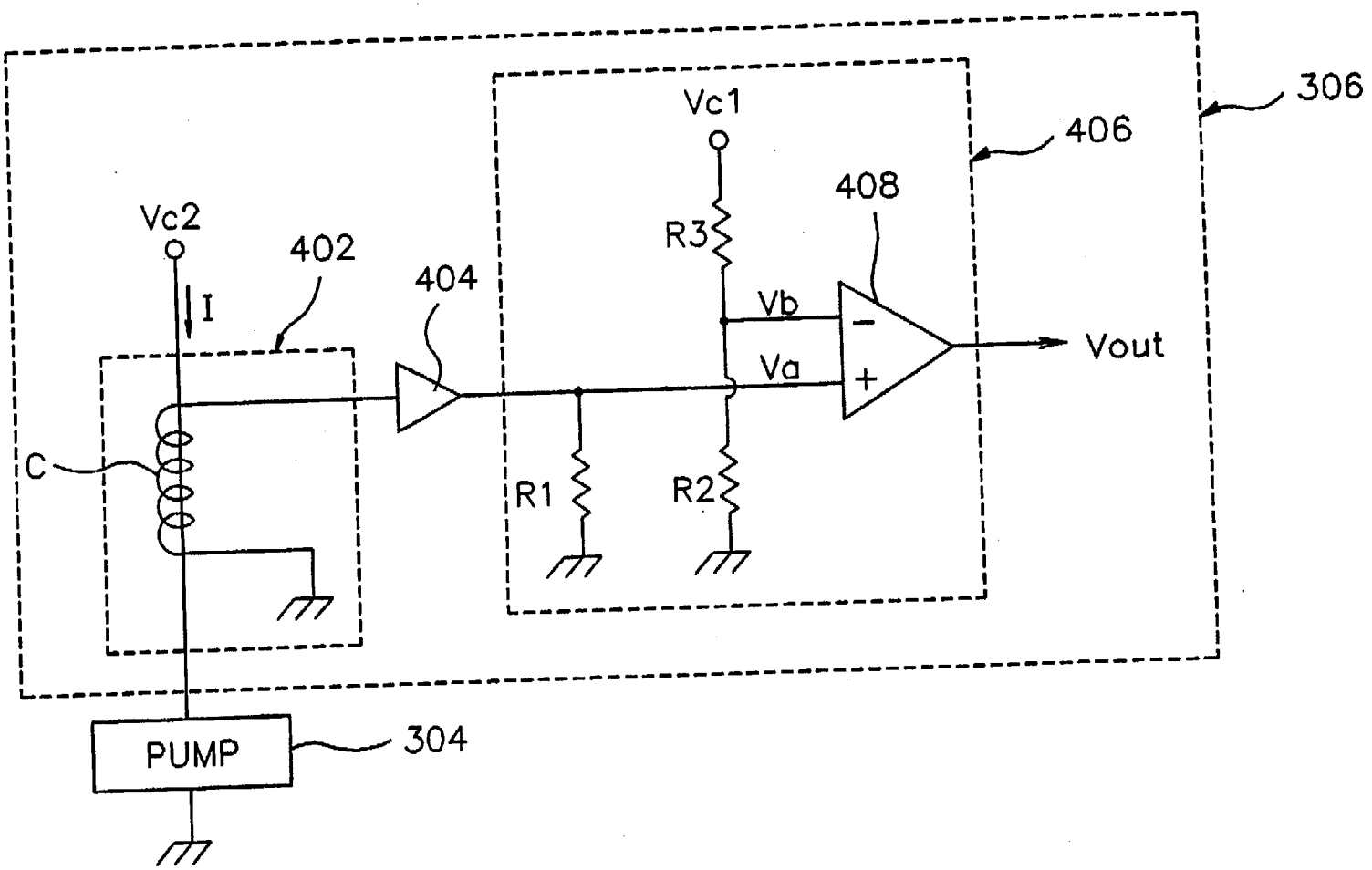
FIG. 4 is a circuit diagram showing the current detecting part of FIG. 3.

FIG. 4 is a circuit diagram showing the current detecting part of FIG. 3. The current detecting part 306 has a motor-current detector 402, an amplifier 404, and a comparing part 406.

The motor-current detector 402 has a coil C. One terminal of the coil C is grounded, and the other terminal thereof is connected to an output terminal. A wire passes through the coil C.

An input terminal of the amplifier 404 is connected to the output terminal of the coil C. An output terminal of the amplifier 404 is connected to an input terminal of the comparing part 406.

The comparing part 406 has an operational amplifier 408, resistors R1,R2,R3, and a bias voltage Vc1. The operational amplifier 408 has an inverting terminal, a non-inverting terminal, and an output terminal. The non-inverting terminal is connected to the output terminal of the amplifier 404 and one terminal of the first resistor R1 in which the other terminal thereof is grounded. The inverting terminal is connected to one terminal of the second resistor R2 in which the other terminal thereof is grounded. One terminal of the third resistor R3, in which the other terminal thereof is connected to an output terminal of the bias voltage Vc1, is connected to the inverting terminal. The output terminal of the operational amplifier 408 is connected to a control signal input terminal of the controller 310 shown in FIG. 3.

Hereafter, the operation of the refrigerator according to the present invention will be described.

When the water is filled in the water tank 302, the controller 310 drives the water-feeding pump by controlling the water-feeding motor driver 308. A water-feeding motor current I, which is applied from the water-feeding motor driver 308 in order to drive the water-feeding pump 304, is detected by the current detecting part 306. The detected water-feeding motor current I is sent to the controller 310. The controller 310 determines the existence of the water in the water tank 302 according to the detected water-feeding motor current I, thereby the controller 310 turns on or turns off the water-feeding pump 304.

The water, which is fed from the water-feeding pump 304, is fed into the water-refrigerating container 314 through the water-feeding tube 318. Then the water-refrigeration continues. At this time, the controller 310 determines the end of the water-refrigeration according to the time period from the timer 322 and the temperature from the water-refrigerating sensor 320. When the water-refrigeration ends, the controller 310 drives the taking-out motor 312 by controlling the taking-out motor driver 316 so that the ice in the water-refrigerating container 314 is taken out.

Hereafter, the operation of each element of the current detecting part 306 shown in FIG. 4 is as follows.

The water-feeding motor current I flows through the wire. The water-feeding motor current I originates from a water-feeding motor-driving voltage Vc2 which is applied from the water-feeding motor driver 308 shown in FIG. 3. When the water-feeding motor current I flows through the wire, an induced voltage is generated across the coil C by the mutual induction between the water-feeding motor current I and the coil C. Here, the induced voltage is directly proportional to the amplitude and the frequency of the water-feeding motor current I.

The amplifier 404 amplifies the amplitude of the current due to the induced voltage at a predetermined rate.

The first resistor R1 is provided to stabilize the current detecting part 306. The higher the value of the first resistor R1 is, the higher the voltage across the first resistor R1 is. Therefore, the first resistor R1 is selected properly according to the sensitivity of the motor-current detector 402.

The voltage across the first resistor R1 is applied to the non-inverting terminal of the operational amplifier 408 as a non-inverting input voltage Va. A divided voltage divided from the bias voltage Vc1 is applied to the inverting terminal of the operational amplifier 408 as an inverting input voltage Vb. Here, the inverting input voltage Vb is expressed as the [formula 1] with the first resistor R1, the second resistor R2, the third resistor R3, and the bias voltage Vc1.

$$Vb=R2/(R2+R3)*Vc1 \quad \text{[formula 1]}$$

If a gain of the operational amplifier 408 is defined as G, the output voltage Vout of the operational amplifier 408 is expressed as the [formula 2] with the non-inverting input voltage Va, the inverting input voltage Vb, and the gain G.

$$Vout=G(Va-Vb) \quad \text{[formula 2]}$$

The inverting input voltage Vb is set as a constant value by the second resistor R2, the third resistor R3, and the bias voltage Vc1. Therefore, the output voltage Vout of the operational amplifier 408 depends on the non-inverting input voltage Va which depends on the detected current by means of the motor-current detector 402.

Hereafter, the operation of the refrigerator will be described according to two operation modes.

Firstly, on being loaded, that is, when water exists in the water tank 302 so that the water-feeding pump 304 operates normally, the operation of the refrigerator is as follows. A first water-feeding motor current flows through the wire by means of the water-feeding motor driver 308 in order to feed the water in the water tank 302 into the water-refrigerating container 314. Generally, on being loaded, the first water-feeding motor current is about 250 mA. The first water-feeding motor current flows through the wire in the coil C. A first induced voltage is generated across the coil C according to the first water-feeding motor current. The first induced voltage is amplified by the amplifier 404 at a predetermined rate. The first amplified voltage is applied to the non-inverting terminal of the operational amplifier 408 as a first non-inverting input voltage. The first non-inverting input voltage is compared with the inverting input voltage Vb so that a first output voltage outputs from the output terminal of the operational amplifier 408.

Secondly, on not being loaded, that is, when there is no water in the water tank 302 so that the water-feeding pump 304 operates in a meaningless revolution, the operation of the refrigerator is as follows. A second water-feeding motor current flows through the wire by means of the water-feeding motor driver 308 in order to feed the water in the water tank 302 into the water-refrigerating container 314. Generally, on not being loaded, the second water-feeding motor current is about 130 mA. The second water-feeding motor current flows through the wire in the coil C. A second induced voltage is generated across the coil C according to the second water-feeding motor current. The second induced voltage is amplified by the amplifier 404 at a predetermined rate. The second amplified voltage is applied to the non-inverting terminal of the operational amplifier 408 as a second non-inverting input voltage. The second non-inverting input voltage is compared with the inverting input voltage Vb so that a second output voltage outputs from the output terminal of the operational amplifier 408.

Meanwhile, the inverting input voltage Vb, which is inputted to the inverting terminal of the operational amplifier 408, is a predetermined constant voltage. Therefore, the first and second output voltages from the operational amplifier 408 depend on the first and second non-inverting input voltages. In the above-mentioned case, the first non-inverting input voltage is higher than the second non-inverting input voltage. Finally, the first output voltage from the operational amplifier 408 is a binary signal of high level, and the second output voltage from the operational amplifier 408 is a binary signal of low level.

The high or low level signal is inputted to the controller 310 so that the controller 310 controls the refrigerator. When the high level signal is inputted to the controller 310, the controller 310 considers the water to exist in the water tank 302 so that the controller 310 operates the water-feeding motor normally. However, when the low level signal is inputted to the controller 310, the controller 310 considers the water not to exist so that the controller 310 stops the water-feeding motor until the water is filled in the water tank 302 up to a predetermined amount.

The current detecting part 306 may be used in the refrigerator not only as a substitute for the water-detecting sensor 113 without the water-feeding sensor 113 but also as an aid for the water-detecting sensor 113 with the water-detecting sensor 113.

By using the refrigerator having the water-feeding apparatus with the current detecting part according to the present invention, the existence of the water in the water tank may be detected accurately without the water-detecting sensor. Also, on being used together with the water-detecting sensor, the existence of the water in the water tank may be detected accurately even if the water-detecting sensor malfunctions.

While the present invention has been particularly shown and described with reference to a particular embodiment thereof, it will be understood by those skilled in the art that various changes in form and details may be effected therein without departing from the spirit and scope of the invention as defined by the appended claims.

What is claimed is:

1. A refrigerator with a water-feeding apparatus comprising:

a water tank which stores water;

a water-refrigerating container which stores the water fed from the water tank via a water-feeding tube;

a water-feeding pump with a motor which feeds the water in the water tank into the water-refrigerating container;

a current detecting part which detects current flowing through the motor and outputs control signals according to the current; and a controller which controls revolution of the motor according to the control signals.

2. The refrigerator with the water-feeding apparatus according to claim 1 in which the current-detector comprises:

a motor-current detector which measures the current flowing through the motor; and a comparing part which compares the detected motor-current with a predetermined reference current and outputs the control signals according to the comparison.

3. The refrigerator with the water-feeding apparatus according to claim 2 in which the motor-current detector is a coil where a wire passes therethrough and one terminal thereof is grounded, and other terminal thereof is an output terminal.

4. The refrigerator with the water-feeding apparatus according to claim 3 in which the current detecting part further has an amplifier between the motor-current detector and the comparing part for amplifying the detected motor-current.

5. The refrigerator with the water-feeding apparatus according to claim 4 in which the comparing part comprises:

an operational amplifier having an inverting terminal, a non-inverting terminal, and an output terminal;

a first resistor in which one terminal thereof is grounded and other terminal thereof is connected to the non-inverting terminal;

a second resistor in which one terminal thereof is grounded and other terminal thereof is connected to the inverting terminal; and a third resistor in which one terminal thereof is connected to a terminal of a bias voltage and other terminal thereof is connected to the inverting terminal.

6. The refrigerator with the water-feeding apparatus according to claim 5 in which the control signals are a high and a low level signal.

* * * * *